US011299886B2

(12) United States Patent
El-Domiaty et al.

(10) Patent No.: US 11,299,886 B2
(45) Date of Patent: Apr. 12, 2022

(54) COMPOSITE STUD WALL PANEL ASSEMBLY

(71) Applicant: Protectiflex, LLC, Callicoon, NY (US)

(72) Inventors: Khaled El-Domiaty, Washington, DC (US); Gary Bullock, Mosman (AU)

(73) Assignee: PROTECTIFLEX, LLC, Callicoon, NY (US)

( * ) Notice: Subject to any disclaimer, the term of this patent is extended or adjusted under 35 U.S.C. 154(b) by 0 days.

(21) Appl. No.: 16/501,524

(22) Filed: Apr. 24, 2019

(65) Prior Publication Data

US 2020/0340244 A1 Oct. 29, 2020

(51) Int. Cl.

| | |
|---|---|
| ***E04C 5/18*** | (2006.01) |
| ***E04B 2/60*** | (2006.01) |
| ***E04B 2/78*** | (2006.01) |
| ***E04B 2/74*** | (2006.01) |
| ***E04B 1/98*** | (2006.01) |

(52) U.S. Cl.

CPC ..... *E04B 2/789* (2013.01); *E04B 1/98* (2013.01); *E04B 2/60* (2013.01); *E04B 2/7409* (2013.01); *E04C 5/18* (2013.01)

(58) Field of Classification Search

CPC .. E04C 2/384; E04C 2003/0473; E04C 2/044; E04C 3/293; E04C 3/294; E04C 5/18; E04B 5/04; E04B 2/789; E04B 2/60; E04B 2/7409; E04B 5/046; E04B 1/98

See application file for complete search history.

(56) References Cited

U.S. PATENT DOCUMENTS

| | | | | | |
|---|---|---|---|---|---|
| 917,478 | A * | 4/1909 | Noble | E04D 3/3605 | 403/392 |
| 1,530,662 | A * | 3/1925 | Hensel | E04B 2/845 | 52/742.1 |
| 1,992,937 | A * | 3/1935 | Bodenstein | E04B 2/845 | 52/327 |
| 2,245,688 | A * | 6/1941 | Krueger | E04B 7/08 | 52/88 |
| 2,934,934 | A * | 5/1960 | Berliner | E04C 2/06 | 52/601 |
| 3,353,322 | A * | 11/1967 | Guddal | B29C 51/22 | 52/741.41 |

(Continued)

FOREIGN PATENT DOCUMENTS

| | | | |
|---|---|---|---|
| CN | 103899039 | A * | 7/2014 |
| GB | 2524045 | | 9/2015 |

(Continued)

OTHER PUBLICATIONS

Machine Translation of CN 103899039 A obtained from the European Patent Office on Apr. 21, 2020 (Year: 2014).*

Derwent Abstract for CN 103899039 A by Han et al. (Year: 2014).*

*Primary Examiner* — Brian D Mattei
*Assistant Examiner* — Charissa Ahmad
(74) *Attorney, Agent, or Firm* — Cassan MacLean IP Agency Inc.

(57) ABSTRACT

A composite stud wall panel assembly, which can be used alone as a blast panel or as a module for wall or roof structures, comprises a frame including a plurality of spaced apart metal studs and metal crossbars interconnecting the studs; and a cementitious aggregate panel, one side of the metal studs being embedded in and permanently connected to the panel along the length of the studs.

6 Claims, 2 Drawing Sheets

(56) References Cited

U.S. PATENT DOCUMENTS 3,466,825 A * 9/1969 Guddal ..... E04B 2/847 52/344
3,484,999 A * 12/1969 Van Der Lely ..... E04B 1/34815 52/79.7
3,812,636 A * 5/1974 Albrecht ..... E04B 5/40 52/334
3,867,995 A * 2/1975 Sanders ..... E04B 1/8218 181/285
4,185,437 A * 1/1980 Robinson ..... E04C 2/384 264/256
4,517,782 A * 5/1985 Shamszadeh ..... E04B 5/40 428/319.1
4,602,467 A * 7/1986 Schilger ..... E04C 2/284 52/319
4,633,634 A * 1/1987 Nemmer ..... E04B 2/62 52/275
4,972,537 A * 11/1990 Slaw, Sr. ..... E01D 19/125 14/73
5,048,257 A * 9/1991 Luedtke ..... E04B 1/16 52/364
5,311,629 A * 5/1994 Smith ..... E01D 22/00 14/73.1
5,335,472 A * 8/1994 Phillips ..... E04B 2/845 52/259
5,391,226 A * 2/1995 Frankowski ..... C04B 28/02 106/696
5,493,833 A * 2/1996 Irimies ..... B21K 1/463 219/98
5,526,629 A * 6/1996 Cavaness ..... E04C 2/384 264/263
5,758,463 A * 6/1998 Mancini, Jr. ..... E04C 2/384 52/309.12
6,000,194 A * 12/1999 Nakamura ..... B28B 19/003 52/783.17
6,026,629 A * 2/2000 Strickland ..... E04C 2/06 52/309.11
6,041,561 A * 3/2000 LeBlang ..... E04B 1/14 52/234
6,209,603 B1 * 4/2001 Kanenari ..... B60C 9/1821 152/209.4
6,216,405 B1 * 4/2001 Smith ..... E04B 2/94 52/235
6,578,343 B1 * 6/2003 Dumler ..... E01D 19/125 14/73
6,708,459 B2 * 3/2004 Bodnar ..... E04C 2/384 52/335
6,754,992 B1 * 6/2004 Byfield ..... E04B 1/2403 403/205
7,757,454 B2 * 7/2010 Smith ..... B28B 1/503 52/315
8,176,696 B2 * 5/2012 LeBlang ..... E04B 1/165 52/252
8,671,637 B2 * 3/2014 LeBlang ..... E04B 1/14 52/252
8,877,329 B2 * 11/2014 Ciuperca ..... B32B 13/12 428/215
9,074,379 B2 * 7/2015 Ciuperca ..... E04G 17/14
9,156,315 B2 * 10/2015 Deal ..... B60C 9/023
9,290,939 B2 * 3/2016 Ciuperca ..... E04C 2/205
10,155,693 B1 12/2018 Spreen
10,161,132 B1 * 12/2018 Maslehuddin ..... E04B 2/14
10,435,887 B2 10/2019 Spreen
2001/0010140 A1 * 8/2001 Ritter ..... E04C 2/06 52/649.1
2004/0074183 A1 * 4/2004 Schneider, III ..... E04B 5/023 52/334
2006/0191232 A1 * 8/2006 Salazar ..... E04C 2/38 52/606
2006/0272251 A1 * 12/2006 Hatzinikolas ..... E04C 3/294 52/340
2009/0224134 A1 * 9/2009 Smith ..... B28B 23/024 249/34
2009/0314186 A1 * 12/2009 Rodgers ..... C04B 28/04 106/706
2011/0225915 A1 * 9/2011 Swartz ..... E04H 9/10 52/309.4
2013/0119576 A1 * 5/2013 Ciuperca ..... C04B 7/14 264/232
2014/0087158 A1 * 3/2014 Ciuperca ..... B32B 7/02 428/215
2016/0060865 A1 * 3/2016 Lee ..... E04B 2/7453 52/483.1
2018/0313055 A1 * 11/2018 Ames ..... E02D 31/004

FOREIGN PATENT DOCUMENTS

GB 2529396 2/2016
JP 01075752 A * 3/1989
JP 08004147 A * 1/1996
JP 11112190 A * 4/1999
WO WO 0133006 A1 * 5/2001
WO WO-2004060827 A1 * 7/2004 ..... C04B 26/26
WO WO 2016024135 A1 * 2/2016
WO 2017/086932 5/2017
WO 2018/213402 11/2018

* cited by examiner

COMPOSITE STUD WALL PANEL ASSEMBLY

FIELD OF THE INVENTION

This invention relates to a composite stud wall assembly.

More specifically, the invention relates to a stud wall assembly, which can be used as protection against blast, ballistic, forced entry, impact, weapons effects, fire and seismic loads. The assembly can be used alone as a blast panel or as a wall or roof panel for modular unit assemblies such as guard booths, trailers and other assemblies for resisting blast, ballistic and/or forced entry loadings.

BACKGROUND OF THE INVENTION

In general, prefabricated blast or building panels are made of reinforced concrete, which is heavy and subject to fragmentation under extreme loads. An object of the present invention is to provide a stud wall panel assembly which is relatively lightweight and provides greater ballistic protection for a given thickness.

SUMMARY OF THE INVENTION

According to one aspect the invention relates to a composite stud wall assembly comprising a frame including a plurality of spaced apart metal studs and metal crossbars interconnecting said studs at locations proximate the ends and at least one location between said ends; and a cementitious aggregate panel, one side of the metal studs being embedded in and permanently connected to the panel along the length of the studs.

BRIEF DESCRIPTION OF THE DRAWINGS

The invention is described in greater detail with reference to the accompanying drawings, which illustrate a preferred embodiment of the invention, and wherein.

DETAILED DESCRIPTION OF THE INVENTION

Figure 1:
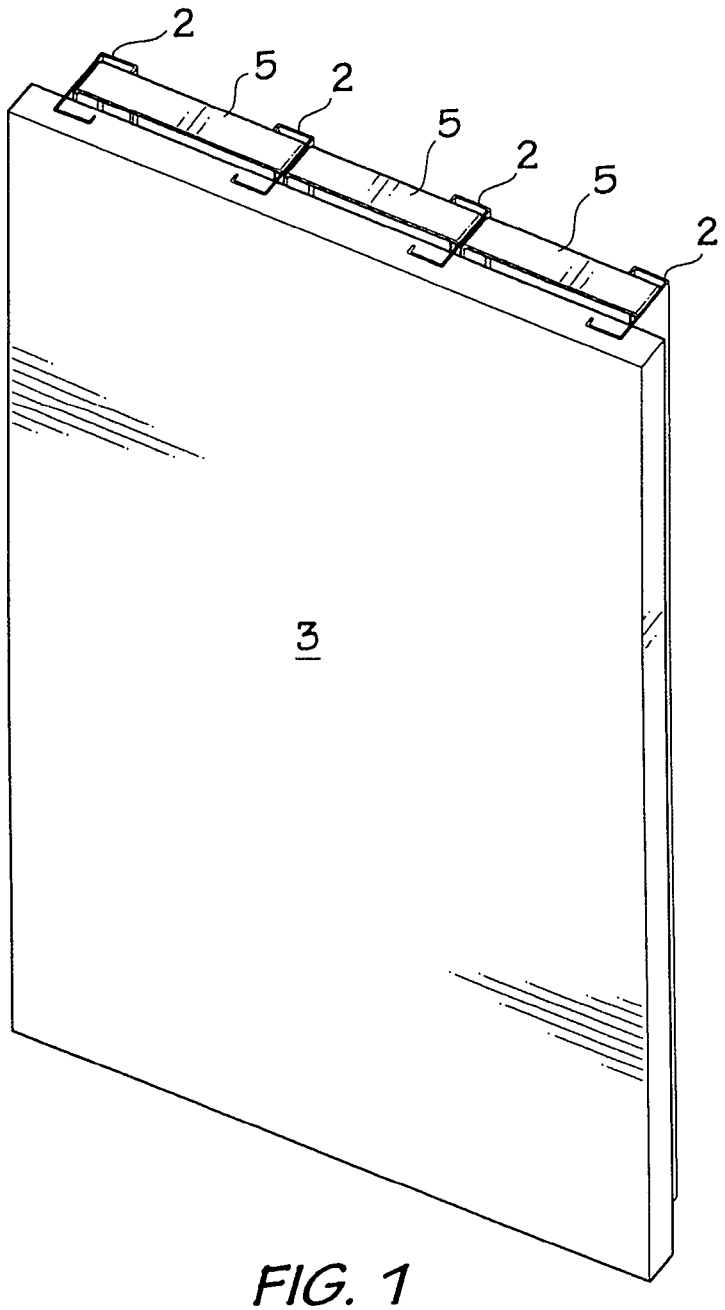
FIG. 1 is an isometric view of a composite stud wall panel assembly as seen from the front and one side in accordance with the invention.
Figure 2:
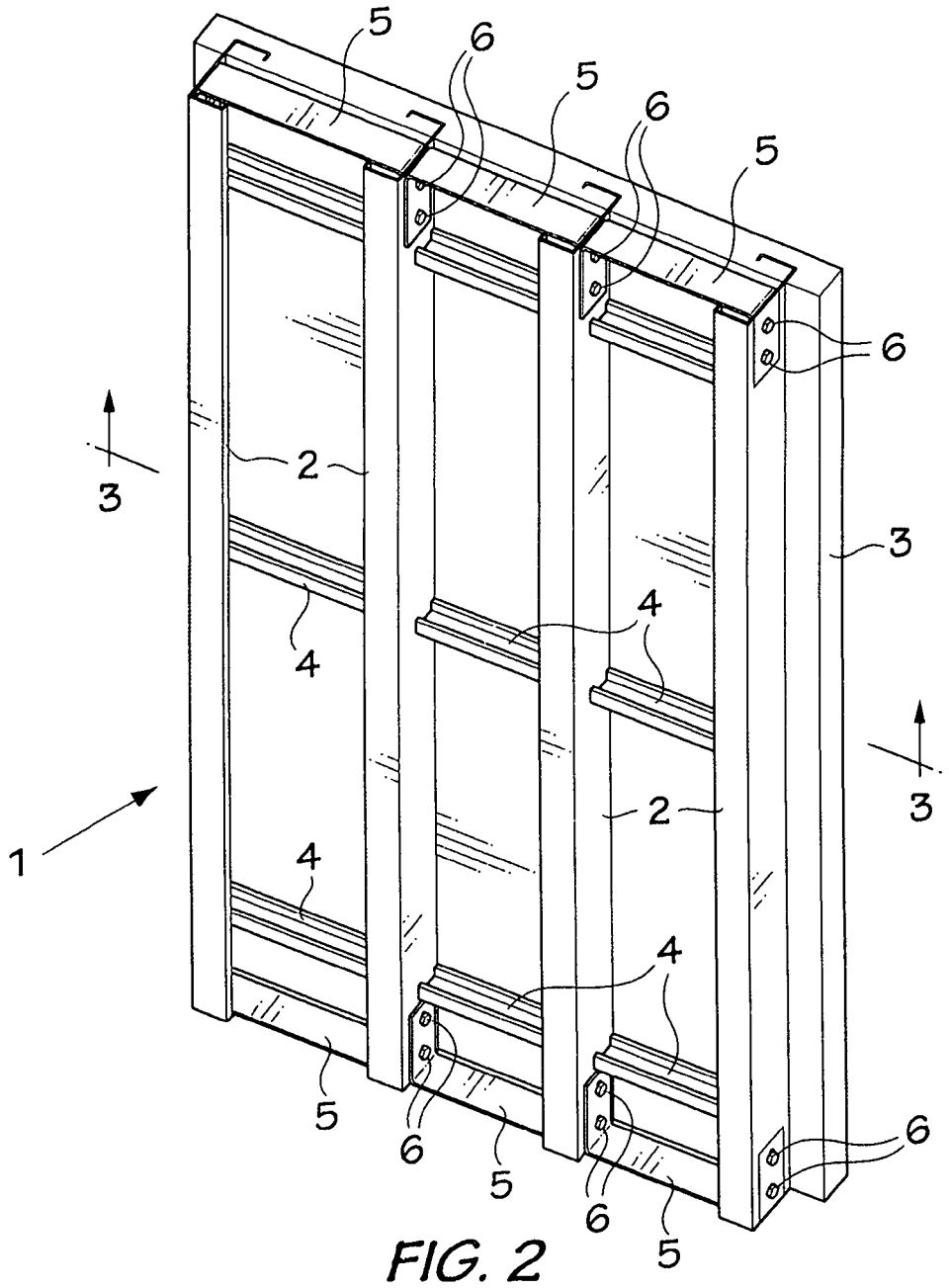
FIG. 2 is an isometric view of the stud wall panel assembly of FIG. 1 and seen from the rear and the other side.
Figure 3:
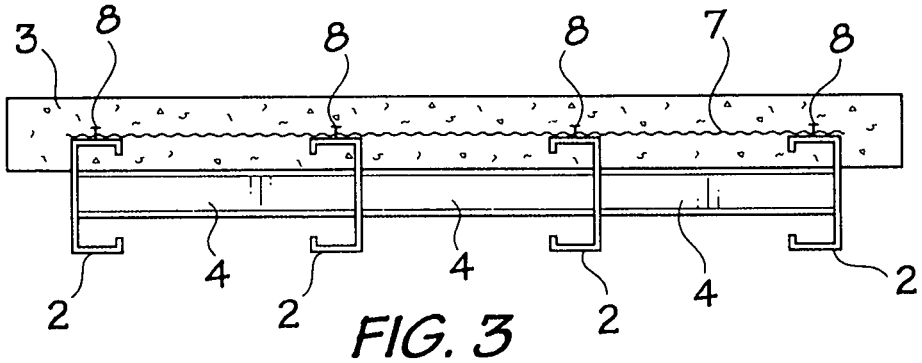
FIG. 3 is a cross section taken generally along line 3-3 of FIG. 2.

With reference to the drawings, the composite stud wall assembly includes a frame indicated generally at 1. The frame 1 is defined by a plurality of spaced apart, vertical metal studs 2 partially embedded in a rectangular panel 3 of a composite material. The studs 2 are braced by horizontal metal crossbars 4 extending between the studs 2 and abutting the panel 3. The crossbars 4 can be embedded in the panel 3. The crossbars 4 are located at the centers and proximate the ends of the studs 2. Generally U-shaped metal straps 5 extend between the ends of the studs 2 and are connected thereto by bolts 6 and nuts (not shown). A 0/90°, 1.5×1.5 inch metal or fiber polymer composite mesh 7 reinforcement (FIG. 3) is molded into the panel 3 at mid-depth and tied to the studs 2 by ¼ inch shear studs 8 (FIG. 3).

Preferably the studs 2 are steel C-beams, the crossbars 4 are steel C-beams, and the straps 5 are steel. However, other metals can be used for the studs 2, the crossbars 4 and the straps 5. The panel 3 is formed of rubber pieces with embedded fibers in a cementitious matrix. A preferred embodiment of the material comprises, in a dry state, 25% by weight blended cement, 15% by weight rubber pieces with embedded polymeric macro reinforcing fibers, 50% sand and 10% crushed stone (see Table 1, which also lists the ingredients used to produce the panel).

TABLE 1

| MATERIAL | Kg/m3 of Mix weight | % by dry weight |
|---|---|---|
| Cement (Blended 80:20) | 450 | 25% |
| Rubber Shred | 272 | 15% |
| Sand | 877 | 50% |
| Stone (10 mm crushed aggregate) | 176 | 10% |
| Total Dry Weight | 1775 kg. | |
| Water | 167 | |
| STRUX BT-50 fiber or equivalent | 1.18 kg | |
| 3 in 1 Mid Range Water Reducer (WRDA ® PN) or equivalent | 1.8 liters | |
| Air Entraining Agent (DAREX AEA ®) or equivalent | | |

STRUX® BT-50 is a registered trademark for polymeric macro reinforcing fibers, which is included in panels with thicknesses of less than 6 inches. WRDA® PN is a registered trademark for an aqueous solution of polycarboxylate and carbohydrates, and DAREX AEA® is a registered trademark for an aqueous solution of a complex mixture of organic acids. Other reinforcing fibers, water reducers and air entraining agents can be used.

The ingredients can be present in the following percentages by dry weight: cement—20 to 30, rubber—10 to 20, sand—40 to 60 and stone—5 to 15.

The composition of panels used in blast and ballistic testing are listed in Tables 2 and 3.

TABLE 2

Panel Composition

| Material | Specific Gravities | Percent by Volume | Weight in Pounds | Volume in Cubic Feet |
|---|---|---|---|---|
| Rubber | 1.07 | 25.56 | 461 | 6.90 |
| ⅜" Stone | 2.78 | 6.41 | 299 | 1.73 |
| Sand (UWP) | 2.76 | 31.96 | 1486 | 8.63 |
| Cement | 3.15 | 10.63 | 564 | 2.87 |
| Flyash | 2.28 | 5.14 | 200 | 1.39 |
| Water | 1.00 | 16.77 | 283 | 4.53 |
| Entrapped Air | | 3.53 | | 0.95 |

TABLE 3

Panel Composition

| Material | Specific Gravities | Percent by Volume | Weight in Pounds | Volume in Cubic Feet |
|---|---|---|---|---|
| Rubber | 1.07 | 28.77 | 530 | 7.77 |
| ⅜" Stone | 2.78 | 3.20 | 150 | 0.86 |
| Sand (UWP) | 2.76 | 31.96 | 1486 | 8.63 |
| Cement | 3.15 | 10.63 | 564 | 2.87 |

TABLE 3-continued

| Panel Composition | | | | |
|---|---|---|---|---|
| Material | Specific Gravities | Percent by Volume | Weight in Pounds | Volume in Cubic Feet |
| Flyash | 2.28 | 5.14 | 200 | 1.39 |
| Water | 1.00 | 16.77 | 283 | 4.53 |
| Entrapped Air | | 3.53 | | 0.95 |

An eight foot by four foot stud wall panel assembly described above was subjected to blast and ballistic testing. The blast test specimens consisted of four six inch deep vertical cold-formed steel studs 2 (C-beams) embedded in a three inch thick aggregate panel 3 having the composition listed in Table 1. The 0/90 degree, 1.5 inch by 1.5 inch carbon fiber mesh was placed in the panel 3 at mid-depth and tied to the vertical studs 2 using the ¼ inch shear studs 8 spaced twelve inches on center. The vertical studs 2 were braced with horizontal crossbars 4 in the form of 2.5 inch deep steel I-beams located at mid-panel height and approximately ten inches from the top and bottom of the frame. One quarter inch bent steel straps 5 were attached to the top and bottom ends of the studs 2 by two one-half inch diameter bolts 6 on each end and nuts (not shown). The assemblies were connected to steel framing. Ammonium nitrate/fuel oil, a widely used bulk explosive mixture was used as the explosive material to develop blast loads in each test.

Two composite stud wall panel assemblies were subjected to three non-simultaneous explosive shots of the same explosive weight (representative of a car bomb) at varying standoffs. The goal of the three shots was to provide composite panel response data at different blast loading conditions as a means of validating the newly developed blast mitigation composite panel system and to compare the system response to that of conventional wall construction materials utilized in the protective design industry.

In addition, a ballistic resistance testing evaluation of the precast panel assembly was conducted within an indoor range at Oregon Ballistic Laboratories in Salem, Oreg. for various thicknesses of the precast panel in accordance with UL 752 and NIJ-STD-0108.01 testing standards. The muzzle of the test barrel was mounted at selected distances from the target and positioned to produce 0-degree obliquity impacts.

US Army Corps of Engineers Protective Design Center Technical Report PDC-TR 06-08 (Revision 1 dated 7 Jan. 2008—APPROVED FOR PUBLIC RELEASE) describes damage levels and levels of protections (LOPs) that can be used to classify the responses for each test. Table 4 provides descriptions for each component damage level and the corresponding building LOP considering the component as a secondary (i.e., non-load bearing) structural element.

TABLE 4

| Component Damage Level Descriptions per PDC-TR 06-08 | | |
|---|---|---|
| Component Damage Level | Description | Building Level of Protection * |
| Blowout | Component is overwhelmed by the blast load causing debris with significant velocities. | Below Antiterrorism Standards |
| Hazardous Failure | Component has failed, and debris velocities range from insignificant to very significant. | Very Low (VLLOP) |
| Heavy Damage | Component has not failed, but it has significant permanent deflections causing it to be unrepairable. | Low (LLOP) |
| Moderate Damage | Component has some permanent deflection. It is generally repairable, if necessary, although replacement may be more economic and aesthetic. | Medium (MLOP) |
| Superficial Damage | Component has no visible permanent damage | High (HLOP) |

* Level of protection corresponding to given damage level for a secondary structural component.

The results for three blast test, 1-3 using the same quantity of ammonium nitrate/fuel oil (ANFO) representative of a car bomb, at standoffs varying between 40 feet (12.2 m) and 100 feet (30.5 m) are summarized in Table 5.

TABLE 5

| Blast Test Results Summary | | | | | |
|---|---|---|---|---|---|
| Test | Specimen | Charge Standoff | Peak Pressure | Positive Phase Impulse | Post-Test Notes |
| 1 | 1 | 100 ft (30.5 m) | 9-10 psi (63-70 kPa) | 49-46 psi-ms (340-390 kPa-ms) | No observable permanent damage or permanent deflection. Response categorized as Superficial Damage/ HLOP |
| 2 | 1 | 60 ft (18.3 m) | 28-31 psi (200-215 kPa) | 96-109 psi-ms (660-750 kPa-ms) | Cracking of panel 3 noted on interior face at interface with rightmost vertical stud 2. Minor hairline cracking noted elsewhere. Minor observed deformation and indentations to the vertical and horizontal steel studs 2. Response |

TABLE 5-continued

| Blast Test Results Summary | | | | | |
|---|---|---|---|---|---|
| Test | Specimen | Charge Standoff | Peak Pressure | Positive Phase Impulse | Post-Test Notes |
| 3 | 2 | 40 ft (12.2 m) | 64-93 psi (450-640 kPa) | 153-178 psi-ms (1050-1225 kPa-ms) | categorized as Moderate Damage/MLOP) Extensive cracking of panel 3 noted on interior face near interface with three rightmost vertical studs 2. Cracking also visible on exterior face of panel 3. A small amount of panel debris projected inward up to 5 feet (1.5 m). Minor observed deformation and indentations to the vertical and horizontal steel studs 2. Response categorized as Heavy Damage/LLOP. |

The ballistic resistance testing evaluation was conducted within an indoor range at the Oregon Ballistic Laboratories for various thicknesses of the precast panel in accordance with UL 752 and NIJ-STD-0108.01 testing standards. The muzzle of the test barrel was mounted at selected distances from the target and positioned to product 0-degree obliquity impacts.

All panel assemblies tested for both ballistic testing standard had overall dimensions of 3 feet (910 mm) wide by 3 feet (910 mm) tall with thickness ranging from 3 inches (76 mm) to 10 inches (254 mm). The two panel composition listed in Tables 2 and 3. For panels with thicknesses less than 6 inches (152 mm), a synthetic macro fiber reinforcement labeled as STRUX BT50® was utilized in the design of the panel assemblies. For panels with thicknesses of 6 inches (152 mm) or greater, carbon-fibre reinforced polymer (C-FRP) rebars labeled as C-BAR® were utilized instead.

Tables 6 and 7 summarize the performance ballistic ratings for the ProtectiFlex precast systems evaluated. Based on the ballistic testing results, a 3-inch (76 mm) thick ProtectiFlex precast panel (as used for the blast-tested composite stud wall system) is rated as UL 752 Level 2 and NIJ-STD-0108.01 Level II.

TABLE 6

| UL 752 Ballistic Rating Summary for the ProtectiFlex Precast Panel System | | | |
|---|---|---|---|
| ProtectiFlex Specimen Number | Designated OBL Number | Thickness in (mm) | UL 752 Level Rating |
| 1 | 17758 | 3 (76) | Level 2 |
| 2 | 17761 | 4 (102) | Level 6 |
| 3 | 17762 | 6 (152) | Level 8 |
| 5 | 17856 | 10 (254) | Level 10 |
| 6 | 17760 | 3 (76) | Level 2 |
| 7 | 17926 | 8 (203) | Level 9 |
| 8 | 18066 | 8 (203) | Level 8 |
| 10 | 18067 | 8 (203) | Level 8 |

TABLE 7

| NIJ-TD-0109.01 Ballistic Rating Summary for the ProtectiFlex Precast Panel System | | | |
|---|---|---|---|
| ProtectiFlex Specimen Number | Designated OBL Number | Thickness in (mm) | NIJ-STD-0108.01 Level Rating |
| 1 | 17758 | 3 (76) | Level II |
| 2 | 17761 | 4 (102) | Level III |
| 3 | 17762 | 6 (152) | Level IV |
| 4 | 17812 | 8 (203) | Level IV |
| 5 | 17856 | 10 (254) | Level IV |
| 6 | 17760 | 3 (76) | Level II |
| 7 | 17926 | 8 (203) | Level IV |

Unified Facilities Criteria (UFC) 4-023-7 (dated 7 Jul. 2008 with Change 1 from 1 Feb. 2017—APPROVED FOR PUBLIC RELEASE) provides design guidance to resist direct fire weapons effects. A UL 752 Level 5 rating can be satisfied with approximately 4 inches (102 mm) of reinforced concrete or 8 inches (203 mm) of fully grouted CMU or brick.

As described above, the stud wall panel assembly of the present invention responded with a High Level of Protection (HLOP) at a standoff of 100 feet (30.5 m), a Medium Level of Protection (MLOP) at a standoff of 60 feet (18.3 m), and Low Level of Protection (LLOP) at a standoff of 40 feet (12.2 m) for the same car bomb-sized explosive charge. As a basis of comparison, UFC 4-010-01 presents conventional construction standoff distances (CCSDs) for various common construction types that would be capable of achieving an LLOP for a similarly sized explosive threat (W I). Representative CCSDs for no-load bearing walls are provided in Table 5.

It can be observed that the standoff required to achieve an LLOP for the stud wall panel assembly of the present invention is similar to that of reinforced concrete (26 feet/8 m) and reinforced masonry (30 feet/9 m), noting that the 40-ft (12.2 m) tested standoff is not necessarily an upper limit for LLOP panel response).

With reference to Table 8 below, comparing the minimum wall weights in Table 8 to the 34 psf (160 kg/m$^2$) for the tested panel, the stud wall assembly provides a 60% weight reduction compared to reinforced concrete (based on a 6-inch/150 mm thick wall with 10-psf/50-kg/m$^2$ insulating materials) and a 40% weight reduction compared to reinforced masonry (based on an 8-inch/200-mm thick wall grouted every fourth cell with 10-psf/50-kg/m$^2$ insulating materials). Excluding the insulating materials, these weight reductions are 55% and 28%, respectively. This significant weight reduction for the stud wall assembly can be advantageous in construction to meet non-blast design requirements. In any case, the tested performance of the stud wall assembly is a significant improvement over conventional unreinforced masonry or metal stud construction, which would require a standoff of well over 100 feet (30.5 m) to achieve an LLOP. Therefore, the testing stud wall assembly can be considered to be a viable construction option for blast design applications.

TABLE 8

Conventional Construction Standoff Distances per UFC 4-010-01 for W I Explosive Threat

| Conventional Wall Construction Type | CCSD for LLOP Non-Load Bearing ft (m) | Minimum Weight per Unit Area psf (kg/m$^2$) |
|---|---|---|
| Metal Studs w/Brick Veneer | 207 (63) | 45* (220) |
| Metal Studs w/EIFS | 420 (128) | 11** (54) |
| Reinforced Concrete | 26 (8) | 85** (415) |
| Reinforced Masonry | 30 (9) | 57** (280) |
| Unreinforced Masonry | 125 (38) | 47** (230) |

*Value includes 44 psf (215 kg/m$^2$) for weight of brick veneer.

**Value includes 10 psf (50 kg/m$^2$) for weight of EIFS or other insulating materials.

The invention claimed is:

1. A composite stud wall panel assembly comprising:

a frame including a plurality of spaced apart metal studs and metal crossbars interconnecting said studs at locations proximate the ends and at least one location between the ends of the studs; and a reinforced cementitious aggregate panel, one side of the metal studs being embedded in and permanently connected to the panel along the length of the studs, wherein said reinforced cementitious aggregate panel contains, by dry weight, 20-30% blended cement, 10-20% rubber pieces with embedded fibers; 40-60% sand and 5-15% crushed stone, wherein the rubber pieces are embedded with polymeric fibers, and wherein the composite stud wall panel assembly is capable of withstanding an extreme loading.

2. The composite stud wall panel assembly of claim 1 including a mesh molded into the panel at mid-depth extending between and connected to the studs.

3. The composite stud wall panel assembly of claim 2, wherein said mesh is a metal or carbon fiber mesh.

4. The composite stud wall panel assembly of claim 2 including shear studs connecting said mesh to the frame studs.

5. The composite stud wall panel assembly of claim 1, wherein said frame studs are steel C-beams, and said crossbars are steel C-beams abutting or embedded in an inner side of the cementitious panel.

6. The composite stud wall pan& assembly of claim 1, wherein said cementitious aggregate panel contains a mixture of 450 kg/m$^3$ of cement, 272 kg/m$^3$ of rubber pieces with embedded fibers; 877 kg/m$^3$ of sand and 176 kg/m$^3$ of crushed stone.

* * * * *